US009574430B2

(12) United States Patent
Diehl et al.

(10) Patent No.: US 9,574,430 B2
(45) Date of Patent: Feb. 21, 2017

(54) DEVICE AND METHOD FOR OBTAINING, ESPECIALLY IN SITU, A CARBONACEOUS SUBSTANCE FROM AN UNDERGROUND DEPOSIT

(75) Inventors: Dirk Diehl, Erlangen (DE); Norbert Huber, Erlangen (DE); Andreas Koch, Neunkirchen am Brand (DE); Michael Koolman, Bubenreuth (DE); Muris Torlak, Nürnberg (DE); Bernd Wacker, Herzogenaurach (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 1039 days.

(21) Appl. No.: 13/578,674

(22) PCT Filed: Jan. 31, 2011

(86) PCT No.: PCT/EP2011/051279
§ 371 (c)(1),
(2), (4) Date: Oct. 22, 2012

(87) PCT Pub. No.: WO2011/101227
PCT Pub. Date: Aug. 25, 2011

(65) Prior Publication Data

US 2015/0308248 A1 Oct. 29, 2015

(30) Foreign Application Priority Data

Feb. 22, 2010 (DE) ..... 10 2010 008 779

(51) Int. Cl.
*E21B 43/24* (2006.01)
*E21B 43/30* (2006.01)
(Continued)

(52) U.S. Cl.
CPC ..... *E21B 43/2401* (2013.01); *E21B 17/18* (2013.01); *E21B 34/06* (2013.01); *E21B 43/305* (2013.01)

(58) Field of Classification Search
CPC ..... E21B 43/2401; E21B 17/18; E21B 34/06; E21B 36/006; E21B 36/04
See application file for complete search history.

(56) References Cited

U.S. PATENT DOCUMENTS 4,010,799 A 3/1977 Kern
4,037,655 A 7/1977 Carpenter
(Continued)

FOREIGN PATENT DOCUMENTS

CA 2304938 A1 2/2001
DE 102007008292 A1 8/2008
(Continued)

*Primary Examiner* — Brad Harcourt

(57) ABSTRACT

An apparatus is provided for delivering a substance containing hydrocarbons from a reservoir. The reservoir can be subjected to thermal energy in order to reduce the viscosity of the substance. The apparatus includes at least one conductor loop for inductively applying current as an electric/electromagnetic heater. A conductor of the conductor loop is surrounded in at least one section by a liquid-carrying conduit. The liquid-carrying conduit is perforated such that when a liquid is supplied the liquid penetrates into the reservoir from the liquid-carrying conduit via a perforation.

6 Claims, 5 Drawing Sheets

(51) Int. Cl.
*E21B 17/18* (2006.01)
*E21B 34/06* (2006.01)

(56) References Cited

U.S. PATENT DOCUMENTS

| | | | | |
|---|---|---|---|---|
| 4,084,637 | A | 4/1978 | Todd | |
| 4,362,610 | A | 12/1982 | Carpenter | |
| 5,289,561 | A | 2/1994 | Costa Filho | |
| 2003/0141053 | A1 | 7/2003 | Haibo | |
| 2006/0131022 | A1* | 6/2006 | Rae et al. | 166/307 |
| 2006/0151166 | A1 | 7/2006 | Maloney | |
| 2010/0258265 | A1* | 10/2010 | Karanikas et al. | 165/45 |
| 2014/0231070 | A1 | 8/2014 | Vinegar et al. | |

FOREIGN PATENT DOCUMENTS

| | | | |
|---|---|---|---|
| DE | 102007040605 | B3 | 10/2008 |
| DE | 102007036832 | A1 | 2/2009 |
| DE | 102008062326 | A1 | 9/2009 |
| EA | 010678 | B1 | 10/2008 |
| RU | 2010954 | C1 | 4/1994 |
| RU | 2090016 | C1 | 9/1997 |
| RU | 22 00 228 | C2 | 3/2003 |

* cited by examiner

DEVICE AND METHOD FOR OBTAINING, ESPECIALLY IN SITU, A CARBONACEOUS SUBSTANCE FROM AN UNDERGROUND DEPOSIT

CROSS REFERENCE TO RELATED APPLICATIONS

This application is the US National Stage of International Application No. PCT/EP2011/051279, filed Jan. 31, 2011 and claims the benefit thereof. The International Application claims the benefits of German application No. 10 2010 008 779.3 DE filed Feb. 22, 2010. All of the applications are incorporated by reference herein in their entirety.

FIELD OF INVENTION

The invention relates to a plant for obtaining in-situ a carbonaceous substance from an underground deposit while reducing the viscosity thereof. Such an apparatus is used in particular for extracting bitumen or extra-heavy oil from a reservoir under a capping, such as that found in incidences of oil shale and/or oil sand in Canada, for example.

BACKGROUND OF INVENTION

In order to allow the extraction of extra-heavy oils or bitumen from the known incidences of oil sand or oil shale, their flowability must be significantly increased. This can be achieved by increasing the temperature of the incidence (reservoir). The increase in flowability can be achieved either by introducing solvents or thinners and/or by heating or fusion of the extra-heavy oil or bitumen, for which purpose heating is effected by means of pipe systems that are introduced through boreholes.

The most widespread and commonly used in-situ method for extracting bitumen or extra-heavy oil is the SAGD (Steam Assisted Gravity Drainage) method. In this case, steam (to which solvents may be added) is forced under high pressure through a pipe which runs horizontally within the layer. The heated fused bitumen or extra-heavy oil, once separated from the sand or rock, seeps down to a second pipe which is laid approximately 5 m deeper and via which the extraction of the liquefied bitumen or extra-heavy oil takes place, wherein the distance between injector and production pipe is dependent on the reservoir geometry.

The steam has to perform several tasks concurrently in this case, specifically the introduction of heat energy for the liquefaction, the separation from the sand, and the build-up of pressure in the reservoir, in order firstly to render the reservoir geo-mechanically permeable for bitumen transport (permeability), and secondly to allow the extraction of the bitumen without additional pumps.

The SAGD method starts by introducing steam through both pipes for e.g. three months, in order firstly to liquefy the bitumen in the space between the pipes as quickly as possible. This is followed by the introduction of steam through the upper pipe only, and the extraction through the lower pipe can commence.

The German patent application DE 10 2007 008 292 A1 already specifies that the SAGD method normally used for this purpose can be complemented by an inductive heating apparatus. Furthermore, the German patent application DE 10 2007 036 832 A1 describes an apparatus in which provision is made for parallel arrangements of inductors or electrodes, which are connected above ground to an oscillator and/or converter.

The earlier German patent applications DE 10 2007 008 292 A1 and DE 10 2007 036 832 A1 therefore propose inductive heating of the deposit in addition to the introduction of steam. If applicable, resistive heating between two electrodes can also be effected in this case.

Using the previously described entities, the electrical energy must always be carried via an electrical forward conductor and an electrical return conductor. This involves significant cost.

In the cited earlier patent applications, individual inductor pairs comprising forward and return conductors, or groups of inductor pairs in various geometric configurations, are subjected to current in order to heat the reservoir inductively. In this case, a constant distance between the inductors is assumed within the reservoir, resulting in a constant heating power along the inductors in the case of homogenous electrical conductivity distribution. In the description, the forward and return conductors are guided in close spatial proximity in the sections in which the capping is breached, in order to minimize the losses there.

As described in the earlier applications, variation of the heating power along the inductors can be effected specifically by sectional injection of electrolytes, thereby changing the impedance. This requires corresponding electrolyte injection apparatus, whose installation can be resource-intensive and costly.

SUMMARY OF INVENTION

Taking this as its starting point, the invention addresses the problem of further optimizing the above-described entity for inductive heating.

The problem is solved according to the invention by the features in the independent patent claims. Advantageous developments and embodiments of the invention are specified in the subclaims.

According to the invention, an apparatus is provided for extracting a substance containing hydrocarbons, in particular bitumen or extra-heavy oil, from a reservoir, wherein the reservoir can be subjected to thermal energy in order to reduce the viscosity of said substance, for which purpose at least one conductor loop for inductively applying current is provided as an electric/electromagnetic heater of the reservoir, wherein a conductor (an inductor) of the conductor loop is surrounded in at least one section by a liquid-carrying conduit and the liquid-carrying conduit (12) is perforated, such that when a liquid is supplied said liquid penetrates into the reservoir (6) from the liquid-carrying conduit (12) via a perforation (21).

The invention therefore relates to "in-situ" extraction, i.e. the extraction of the substance containing hydrocarbons directly from the reservoir in which this substance is enriched, without working the reservoir in the open. A reservoir is understood preferably to be an oil sand deposit that is situated underground.

According to the invention, no provision is made for introducing steam via the liquid-carrying conduit. A combination which additionally features the SAGD method can be advantageous, however, e.g. the inductor being cooled as per the inventive apparatus and steam being introduced via a further pipe or a further tube.

A section of the conductor is understood to be a partial length of the conductor. Assuming that the conductor is essentially a twisted cable which is encased by a pipe-shaped sleeve, a section of the conductor is understood to be a partial length along the extent of the cable and the sleeve.

A conductor is understood in particular to be a serial resonance circuit or part thereof, which is provided in a cable-type structure with external insulation. According to the invention, this is surrounded by a liquid-carrying conduit.

The liquid-carrying conduit is understood to be an extended hollow body, e.g. a pipe or a tube, through which liquid can be transported.

As a result of providing a liquid-carrying conduit, a liquid can be carried along the conductor and into the reservoir. Depending on the embodiment of the liquid-carrying conduit, the following advantages can be derived:

i) Increased electrical conductivity in the reservoir due to the introduction of liquid into the reservoir.

One of the problems that occurs in the context of electromagnetic heating by means of inductors in many deposits is specifically that the electrical conductivity in the deposit can be relatively low, such that the resulting thermal power that is introduced into the deposit may be inadequate, or even that high energy losses occur in the immediate environment of the deposit due to the significant penetration depths of the magnetic fields. An increase in the electrical input power, which would significantly compromise the profitability and the environmental friendliness of the process, can therefore be avoided according to the invention.

ii) Increased displacement of the substance containing hydrocarbons, e.g. the oil, due to the introduction of liquid into the reservoir.

A further problem that occurs in the context of electromagnetic inductive heating is specifically the incomplete or inadequate displacement of the oil from the deposit during the extraction, wherein this can adversely affect the extraction rate or even bring the extraction to a standstill. Using the SAGD method according to the prior art, the oil displacement occurs as a result of the expansion of the steam chamber in the deposit. Without the additional introduction of steam, a steam chamber is not necessarily present when the inventive electromagnetic inductive heating is used and therefore oil displacement due to a steam chamber cannot take place. This could only be achieved by introducing a very high electrical power via the inductors, though this should preferably be avoided.

iii) Cooling of the conductor by virtue of the liquid being carried directly alongside or in the vicinity of the conductor, in order to counteract any heating of the conductor due to the heated environment of the conductor or to absorb any heat that has already accumulated in the conductor. Furthermore, it can be advantageous that the environment of the conductor can also be cooled in order to prevent boiling water in the reservoir from coming into direct contact with the conductor or its casing, wherein it should nonetheless be noted that boiling of water in the reservoir is generally advantageous in order to achieve a displacement of oil, for example.

As a result of cooling the conductor, the electrical conductivity in the immediate environment of the conductor can be reduced and therefore the geometry-related high heating power density can be reduced directly at the conductor. It is thus possible to achieve a more homogeneous heating power density in the reservoir.

The cooling is particularly advantageous at greater deposit depths, e.g. more than 130 m, because overheating of the inductor could otherwise occur, e.g. at temperatures of approximately 200° C. or more. In particular, plastic insulation of the inductor could not lastingly withstand such a high temperature. It should be noted here that the boiling temperature of water in the reservoir at a depth of 130 m or more can be approximately 200° C.

The heat of the conductor includes heat resulting from ohmic losses in the conductor, but the heat from the reservoir, which the conductor would absorb from the reservoir without corresponding cooling from the environment, can be more significant.

The pipe wall heat is advantageously carried away as a result of the liquid being in contact with a pipe wall, which itself is in contact with the reservoir.

Further Joulean losses in the conductor can dissipate into the liquid via the outer insulation of the conductor, wherein said outer insulation is in contact with the liquid and the liquid is carried in an outer pipe.

In the following, the features for cooling the conductor are explained first. The inventive idea here is based essentially on a liquid-carrying conduit comprising a closed liquid circuit, wherein cool liquid flows along the conductor within the liquid-carrying conduit, is heated up in the reservoir, and is then carried out of the reservoir again. The additional inventive idea is then explained on the basis of the above, wherein in addition to or as an alternative to the cooling the liquid is fed via the liquid-carrying conduit into the reservoir, where it is distributed in the ground in order to achieve further effects, e.g. improving the conductivity in the reservoir.

1) Cooling the Conductor:

In a preferred embodiment, the liquid-carrying conduit and the conductor can be so arranged relative to each other that a liquid in the liquid-carrying conduit has a cooling effect on the conductor. In this case, it is irrelevant whether this is waste heat from the conductor itself or heat that acts on the conductor from the outside, i.e. from the reservoir that has been heated up by the conductive conductor. The cooling effect can be boosted by moving the liquid, in particular along the conductor while recirculating or exchanging the liquid, since this allows warm liquid to be carried away and cool liquid to flow in.

For the sake of completeness, it should be noted that in a further advantageous embodiment, the liquid-carrying conduit can be part of a largely closed liquid circuit, wherein provision is made for a heat exchange means, in particular at the surface and not within the reservoir, in order to cool down a liquid that has been heated up within the liquid-carrying conduit.

In a further advantageous embodiment, the recooling of the liquid can be done by means of pipes that lead through a colder region of the reservoir, i.e. the liquid is not brought to the surface but merely circulates deep underground. In this case, provision is preferably made for installing a pump deep underground. In this case, the heating power that has been electrically introduced is advantageously not removed from the reservoir but is merely distributed differently.

The liquid-carrying conduit can advantageously be embodied as a tube and/or pipe, wherein the conductor is arranged within the tube or the pipe, in particular such that a liquid flows around the conductor when said liquid is supplied. Optimal transfer of heat from the conductor to the liquid can be ensured thus.

In particular, the tube and/or the pipe can be arranged approximately coaxially—centered—relative to the conductor, wherein provision is made in particular for at least one ridge within the tube or the pipe for holding or positioning the conductor or for stabilizing the position of the conductor within the tube or the pipe. Further ridges can be provided in an axial direction of the tube/pipe, in order to secure the position of the conductor. Alternatively, a ridge can also feature an axial elongation, which even extends along the entire length of the tube/pipe in a specific embodiment.

Alternatively, the conductor can also be so arranged as to move freely within the tube or the pipe, i.e. the conductor is not centered in the tube or in the pipe and holding means are not provided.

In a further embodiment, the liquid-carrying conduit can be embodied as a multiplicity of tubes and/or pipes. Moreover, a multiplicity of capillaries and/or a porous material can be provided for the purpose of transporting the liquid in the liquid-carrying conduit. These variants are preferably arranged such that the conductor is surrounded by the multiplicity of tubes and/or pipes and/or capillaries and/or the porous material, wherein the multiplicity of tubes and/or pipes and/or capillaries and/or the porous material and the conductor are preferably arranged within a shared tubular outer sleeve. In particular, these cited means for carrying the liquid are all parallel to each other or twisted. These embodiments can be understood to mean that the liquid does not flow directly around the conductor, but that tubes/pipes are externally attached to the conductor.

For the sake of completeness, it should be noted that a reverse approach is also conceivable here, whereby a conductor can be composed of a multiplicity of part-conductors and these part-conductors can be arranged around the liquid-carrying conduit.

In a development of the previous embodiments, the liquid-carrying conduit can be designed in the form of a multiplicity of tubes and/or pipes, such that provision is made for at least one first tube and/or pipe in which the liquid flows in an opposite direction to a flow direction of the liquid in a second tube and/or pipe, of which there is at least one. In this way, it is possible to form a closed circuit, for example. Alternatively, liquid could also be pumped into the liquid-carrying conduit from two locations above ground, wherein only a subset of the available tubes or pipes are replenished at each of the two locations. By virtue of a contra-rotating movement of liquid, a more homogeneous temperature is advantageously achieved along the conductor.

In a development of the invention, thermal insulation means can be arranged between the liquid-carrying conduit and the reservoir, in particular between the liquid-carrying conduit and the outer sleeve, wherein the thermal insulation means are designed in particular as a hollow space which is filled with air or gas or which encloses a vacuum. The thermal insulation of the liquid-carrying conduit relative to the reservoir is particularly advantageous in this case, since only a minimal portion of the inductively introduced heating power is then carried away again by the liquid cooling in the case of a suitable embodiment.

Provision can also be made for a pressurization means for increasing the pressure of a liquid or for circulating the liquid, in particular a pump, such that movement of the liquid in the liquid-carrying conduit is achieved by means of the pressurization means. A cooling circuit can be operated in this way.

Natural circulation possibly including a boiling process (e.g. thermosiphon) can also be provided as an alternative to the active pump.

Further elements of the overall system in addition to the liquid-carrying conduit and the pump can be in particular a container for the liquid, a heat exchanger and further overground or underground hydraulic connections. In this case, the container can be embodied for use at atmospheric pressure or as a pressure tank. Provision can also be made for a manostat, by means of which the liquid is maintained at higher pressure as a coolant and circulates at high pressure in order to prevent boiling as a result of a high power input. The overall system preferably features a return conduit for carrying the liquid to the surface.

In a particularly advantageous embodiment of the invention, the liquid-carrying conduit features a perforation such that when a liquid is supplied the liquid can pass into the reservoir from the liquid-carrying conduit, and the perforation in turn features holes which can be so configured in terms of shape and/or size and/or distribution that when a liquid is supplied at a predefined pressure the conductor is adequately cooled over the entire length of the conductor loop section that is surrounded by the liquid-carrying conduit.

In particular, this can be achieved by ensuring that the liquid-carrying conduit is continuously filled with sufficient liquid over its length and/or that liquid which has been heated by the conductor is conveyed out of the liquid-carrying conduit through the holes. Alternatively or additionally, a required quantity of low-temperature cooling liquid can subsequently flow through the liquid-carrying conduit.

The above cited effect is preferably produced when the pressure that is applied by means of the supply to the liquid in the liquid-carrying conduit is adapted to a predefined perforation in such a way that a discharge of the liquid through the perforation is ensured over an extended period of application.

The above described arrangements are particularly advantageous in that an environment in the reservoir is thermally insulated by virtue of the liquid that is carried through the liquid-carrying conduit and/or in that the conductor is cooled by the liquid that is carried through the liquid-carrying conduit.

Water can be provided as a liquid for cooling, in particular water that has been desalinated and/or decalcified and/or contains a frost protection means, e.g. glycol. Saltwater, oil, emulsions or solutions can also be provided.

The basic form of the liquid can preferably be an extracted liquid that can be separated from the desired extraction material that is extracted from the reservoir.

With regard to the cooling, it can be stated in summary that by virtue of the inventive arrangement, overheating of the inductor (which also represents a risk at greater depths) can be avoided and/or the service life can be extended in comparison with an uncooled inductor. The arrangement makes it possible to achieve higher and more cost-effective power densities.

The provision of a perforation in order thereby to achieve an injection of the (coolant) liquid into the reservoir is also advantageous because the heat that is carried away from the conductor remains in the reservoir and is not removed from the reservoir as in the case of a closed cooling circuit with recooling at the surface. The injection of the liquid into the reservoir is now described in greater detail below.

2) Feeding Liquid into the Reservoir:

Excepting the fact that the following does not relate to a closed liquid circuit and that liquid is intentionally "lost" in the reservoir, the above cited features can also be implemented in an identical or similar manner when feeding the liquid into the reservoir. The resulting advantages (e.g. the improved cooling) are still produced correspondingly.

According to the invention, the liquid-carrying conduit is perforated such that, when a liquid is supplied, the liquid penetrates or is introduced into the reservoir from the liquid-carrying conduit. Perforation is understood to signify e.g. holes or slots that are located in a liquid-carrying conduit, such that liquid can escape from the interior of the liquid-carrying conduit outwards into the environment of the holes or slots. In addition to the cited holes and slots, the liquid-carrying conduit can also consist at least partly of porous material or capillaries, such that the liquid can be discharged into the environment via these means.

In this case, the introduction of the liquid into the reservoir can increase the electrical conductivity of the reservoir and/or the pressure in the reservoir.

As mentioned above, a pressurization means, in particular a pump, can be provided for the purpose of increasing the pressure of a liquid or circulating the liquid, such that a liquid can be introduced into the liquid-carrying conduit at a higher pressure using the pressurization means. In particular, the pump should be capable of generating so much pressure that a predefined quantity of liquid penetrates into the reservoir via the perforation. A "higher pressure" therefore means that an environmental pressure in the reservoir is to be overcome. The hydrostatic pressure in the reservoir must be exceeded in the environment of the perforation in order that the liquid can emerge, wherein this can be achieved at a pressure of e.g. 10,000 hPa (10 bar) to 50,000 hPa (50 bar).

The perforation can preferably be embodied and/or means can preferably be provided such that any ingress of solids and/or sand from the reservoir is largely prevented. For example, the term "gravel pack" is used to refer to such means.

In a particularly advantageous embodiment of the invention, the perforation features holes which can be so configured in terms of shape and/or size and/or distribution that when a liquid is supplied at a predefined pressure the liquid is discharged in a distributed manner along a length of the liquid-carrying conduit through the perforation into an environment of the conductor loop in the reservoir, such that the electrical conductivity of the reservoir is changed and/or the pressure in the reservoir is increased. In particular, the liquid can be controlled in such a way that the electrical conductivity within the reservoir is predominantly increased over the extent thereof, and/or that the electrical conductivity in the reservoir is lowered in the immediate environment of the conductor.

The perforation should preferably be designed such that the entire length of the liquid-carrying conduit, with the exception of the supply from the surface to the target region in the reservoir, discharges the same quantity of liquid in each section.

The pressure increase in the reservoir is particularly advantageous in that the substance containing hydrocarbons is consequently displaced more effectively in the reservoir, and/or an underpressure in the reservoir (due to the extracted of the substance) is consequently avoided.

The above cited effects, increasing the conductivity and increasing the pressure, are preferably produced when the pressure that is applied by means of the supply to the liquid in the liquid-carrying conduit is adapted to a predefined perforation in such a way that a discharge of the liquid through the perforation is ensured over an extended period of application.

Suitable liquids to be supplied include in particular water or an organic or inorganic solution as an electrolyte, in particular also for the purpose of increasing the conductivity.

The liquid can preferably comprise at least one of the following components: salts, weak acids, weak bases, $CO_2$, or solvents containing in particular alcanes such as methane, propane, butane, for example.

In order to further increase the pressure in the reservoir, a valve in an extraction pipe for removing the liquefied substance containing hydrocarbons from the reservoir can be closed, and subsequently opened as a function of a predefined time period being completed or a predefined pressure within the reservoir being reached. The pressure can therefore be increased during said time period because no material leaves the reservoir and additional liquid is introduced.

In particular, closing the liquid circuit is not necessary if a perforation is present in the liquid-carrying conduit. For example, two discrete liquid-carrying conduits can be provided for the conductor loop, one for each half of the conductor loop, wherein both of the liquid-carrying conduits terminate in the reservoir without the liquid being pumped back to the surface.

The composition of the liquid that is fed into the reservoir in liquid form has already been explained. It is particularly advantageous here if the liquid is at least partially or even wholly extracted from the extracted mixture of water-oil and bitumen. To this end, the desired substance to be extracted should be separated from the extracted mixture of water-oil and bitumen, and the aqueous residue then treated or processed. This can nonetheless be effected far more easily than the injection of steam.

The mixture of water-oil and bitumen that is extracted can first undergo separation of oil and/or gas from the liquid. This results in a residual liquid—also called produced water—which still contains oil fractions, suspended matter and sand, and a multiplicity of chemical elements or compounds. However, removal of the remaining oil fraction or even of many chemical elements can now be omitted, since the residual liquid that is fed back into the reservoir only contains substances that were previously already present in the reservoir and flushed out during the extracted. The fact that the residual liquid is according to the invention introduced into the reservoir in liquid form and not in a gaseous state is another reason why further reprocessing of the residual liquid is unnecessary. Obtaining feed water for steam generators would require expensive equipment and significant energy consumption, however.

Processing of the residual liquid should mainly include sand separation, since this can lead to blocking and sanding up of the liquid-carrying conduit when the residual liquid is fed back into the reservoir. This would hamper continuous operation.

In an advantageous embodiment, desalination of the residual liquid can also be performed after the sand removal, in order to prevent an excessive salt concentration in the reservoir as a result of continuous introduction of the processed residual liquid.

As a result of introducing the residual liquid after desalination and sand removal, the viscosity within the reservoir can be reduced, i.e. the flow properties of bitumen can be improved. It also results in an increase in the stability of the reservoir.

In addition to the cited components, a heat exchanger can also be provided for the purpose of bringing the processed residual liquid up to a higher temperature, in order thereby to prevent unwanted cooling of the reservoir and a resulting pressure drop or increase in viscosity.

BRIEF DESCRIPTION OF THE DRAWINGS

The present invention and its developments are explained in greater detail below in the context of an exemplary embodiment and with reference to figures providing schematic illustrations, in which.

DETAILED DESCRIPTION OF INVENTION

Corresponding parts in the figures are denoted by the same reference signs in each case. Parts that are not explained in greater detail are known generally from the prior art.

Figure 1:
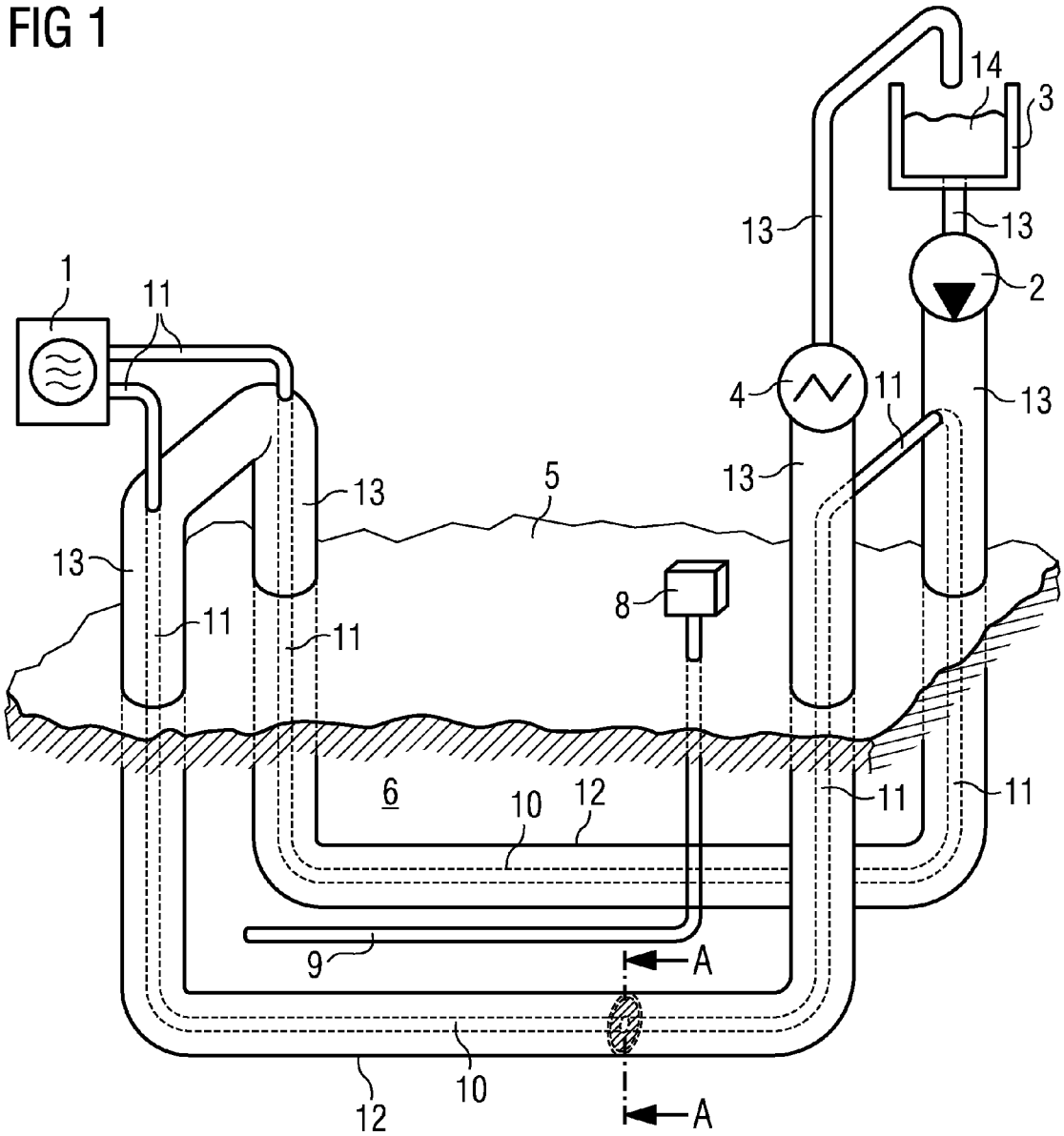
FIG. 1 shows an apparatus in which an inductor is cooled.

FIG. 1 shows a schematic illustration of an apparatus for obtaining in-situ a substance containing hydrocarbons from an underground deposit 6 (reservoir) while reducing the viscosity thereof, provision being made for cooling of inductors 10. Such an apparatus can be e.g. an apparatus for obtaining bitumen from an incidence of oil sand. The deposit 6 can be in particular an incidence of oil sand or oil shale from which bitumen or other heavy oils can be obtained.

Also illustrated is a pipe 9 for introducing steam, wherein said pipe 9 is essentially arranged between parallel sections of an inductor 10 within the reservoir 6 and is supplied via a steam generator 8. The steam is forced into the reservoir 6 by means of nozzles (not shown) that are distributed along the length of the pipe.

The illustration does not include a production pipeline via which the substance extracted from the deposit 6 is collected and transported out of the deposit 6 to the surface 5.

The apparatus for obtaining in-situ a substance containing hydrocarbons additionally features an inductor 10 that runs in boreholes within the deposit 6. The inductor 10 or sections thereof constitute the conductor as described in the invention. A closed conductor loop is formed, consisting of the two (forward and return) conductors of the inductor 10, these extending horizontally in the deposit, and of conductor pieces 11 that effect little or no heating and run above ground or from the surface 5 into the deposit 6 in order to provide the power connection for the inductor 10. Both loop ends of the conductor loop are arranged above ground in the figure, for example. On the right-hand side of the figure, the loop is simply closed; see conductor piece 11 in the figure. On the left-hand side is an electricity supply 1 including any electrical entities such as voltage converters and generators that are required, and being used to apply the required current and the required voltage to the conductor loop, such that the inductors 10 are used as conductors for an electric/electromagnetic heater for generating heat in the deposit 6.

The inductors 10 act as an inductive electrical heater in relation to at least parts of the deposit 6. Due to the conductivity of at least parts of the deposit 6, the latter can be heated largely concentrically around the two preferably parallel sections of the inductor 10.

The heating power of the conductor loop can be significantly reduced by means of suitable routing in regions where it runs outside of the actual deposit 6, e.g. in the conductor pieces 11. In this way, the heating power can be introduced into defined regions of the deposit 6. In particular, the inductor 10 can comprise rod-shaped metallic conductors or twisted metallic cables that are made of a particularly conductive metal and form a resonance circuit.

According to the figure, a cooling circuit for cooling the inductor 10 is provided in addition to the electrical circuit. The cooling circuit comprises a liquid-carrying conduit 12 that almost completely encases the length of the conductor loop as per the figure. Only the inductor 10 requires a casing. A casing is not necessary outside of the deposit 6, though it may be advantageous since the liquid-carrying conduit 12 can then be installed jointly with the conductor loop, thereby allowing a simpler installation.

According to the figure, those sections of the cooling circuit which are not explicitly provided for the purpose of cooling are marked as liquid entry/exit lines 13. According to the figure, the liquid circuit on the left-hand side is simply closed to form a ring, such that the liquid that is carried through a first liquid-carrying conduit 12 along a first section of the inductor 10 is carried back through a second liquid-carrying conduit 12 along a second section of the inductor 10. The aboveground components for providing the liquid are shown on the right-hand side of the figure. Said components comprise a container 3, in which the liquid 14 used for cooling is located. A pump 2 is also provided, for the purpose of pumping the liquid 14 into the cooling circuit and ensuring the flow speed. Provision is further made for a recooling unit 4, by means of which the heated cooling liquid can be cooled down.

There are many conceivable variants with regard to the arrangement of the inductor and the cooling circuit. A further recooling unit could also be present on the left-hand side of the figure, for example. Furthermore, a plurality of cooling circuits could be present. Forward and return transport of the liquid could take place along a single section of the inductor 10 and not along the whole loop.

The liquid-carrying conduit 12 in the figure is designed as a coaxial casing of the inductor 10, such that the inductor 10—or a casing of the inductor 10—is as far as possible fully surrounded by a cooling liquid during operation.

During live operation, the apparatus can therefore be operated such that when current is applied to the inductor 10, thereby heating the environment of the inductor 10 in the deposit 6, a cooling liquid is continuously carried through the liquid-carrying conduit 12 and along the inductor 10. The inductor 10 heats the ground in the environment of the inductor 10, whereby the heated ground itself becomes a thermal source. The inductor 10 must be protected against high temperatures. This is done by means of the cooling liquid in the liquid-carrying conduit 12 providing the external cooling of the inductor 10 as described above, whereby the inductor 10 is thermally insulated and the temperature absorbed by the inductor 10 is carried away again, such that the inductor 10 does not heat up, or at least only heats up slightly or to a small extent.

In order to improve this effect, the liquid-carrying conduit 12 can be additionally encased by a thermal insulator.

It is thus possible in particular to prevent any boiling of water directly against the inductor 10 in the deposit 6, which would have a negative effect on an uncooled protective casing of the inductor 10 since the protective casing is provided for electrical insulation of the inductor 10 and normally consists of plastic, but a long-term increase in temperature could degrade the plastic. It should nonetheless be noted here again that boiling of liquid in the reservoir is entirely advantageous per se.

The inductor 10 is ideally integrated in the liquid-carrying conduit 12 and can be installed as a unit. Various embodiments of such combined conductors and cooling elements are explained in the following.

Figure 2:
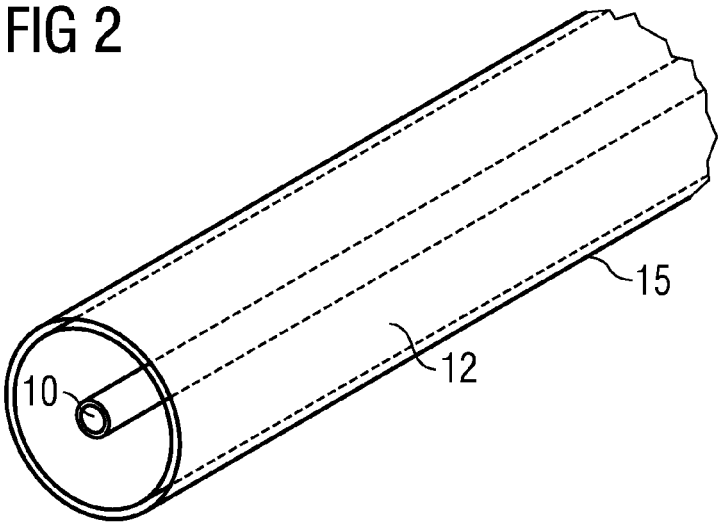
FIG. 2 shows a perspective illustration of a cooled inductor.

FIG. 2 schematically shows a section of an inductor 10 with a surrounding cooling element in a perspective illustration. An inductor 10 that is centrally arranged in a tubular casing 15 of the liquid-carrying conduit 12 is surrounded by a liquid-carrying conduit 12. The positioning of the inductor 10 can be determined solely by the flowing liquid in the liquid-carrying conduit 12. Centering is not provided according to FIG. 2. To a large extent, the inductor 10 can therefore move freely in the liquid-carrying conduit 12 and could e.g. come to rest on the inner side of the liquid casing due to its weight. However, various embodiments are proposed below for specific positioning or holding means in the liquid-carrying conduit 12.

The diameter of the inductor 10 can preferably be 30-100 mm. The annular gap width of the inductor 10 is preferably 5-50 mm and the mass flow of the cooling medium within the liquid-carrying conduit 12 is preferably 5-100 l/min.

Cross sections of cooled conductors are illustrated schematically in the following. The cross section represents a plane of section as indicated by A-A in FIG. 1.

Figure 3:
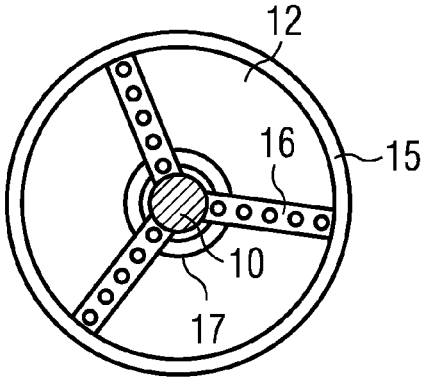
FIGS. 3, 4, 5, 6 show cross sections of various inductors with a liquid-carrying conduit.

According to FIG. 3, a support of the inductor 10 takes the form of e.g. star-shaped spacers or ridges 16, wherein two to five spacers are preferably used. However, a solution using only one ridge 16 is also conceivable. The ridges 16 are preferably attached to the inner wall of the casing 15 and are connected at the center by means of stabilizers 17 or attached directly to the outer sleeve of the inductor 10. The inductor 10 is located coaxially at the center of the casing 15 of the liquid-carrying conduit 12 and is either installed as a unit with the casing 15 and the ridges 16 or is drawn through subsequently.

The liquid-carrying conduit 12 is created by the hollow spaces within the casing 15.

In the case of ridges 16 that are embodied along the entire length, a plurality of chambers are formed at the same time between the ridges 16, wherein the cooling liquid can flow in different directions through said chambers.

The width of the ridges 16 can be in the range of 5-30 mm, for example, such that the pressure losses of the cooling medium in the liquid-carrying conduit 12 do not become excessive.

Figure 4:
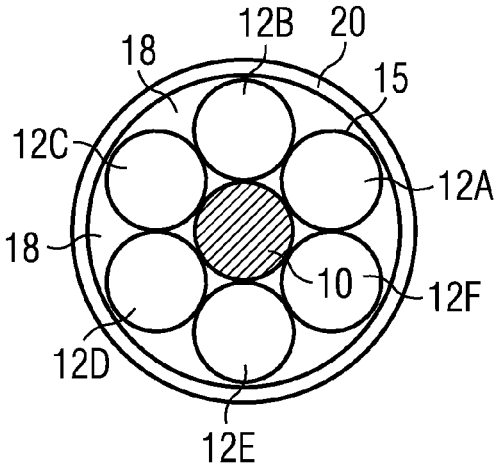

As shown in FIG. 4, a plurality of tubes or pipes 12A, 12B, . . . , 12F are provided as a liquid-carrying conduit 12 in the annular gap (i.e. within an outer sleeve 20) around the inductor 10. In this case, bidirectional transport of the cooling medium in the tubes/pipes is conceivable. In addition, a thermal insulator 18 between the tubes/pipes and the outer sleeve 20 can also be used, either as part of the outer sleeve 20 or as a separate element. This is also understood to mean that these intermediate spaces can remain empty, i.e. air or a specific gas or a vacuum can be used for thermal insulation.

The thickness of a thermal insulating layer can preferably be between 3 and 50 mm.

Figure 5:
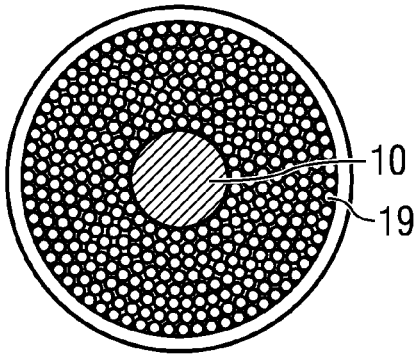

In FIG. 5, the cooling medium is carried via capillaries 19 as a liquid-carrying conduit 12. Alternatively, a porous material can be used for this purpose. In particular, these variants have the advantage that the liquid flow within the liquid-carrying conduit 12 can be controlled more effectively and the position of the inductor 10 relative to the liquid-carrying conduit 12 can be predetermined exactly. This can be advantageous since the induced field does not have the same strength on all sides of the inductor 10, depending on the alignment of the two inductors 10 relative to each other.

Figure 6:
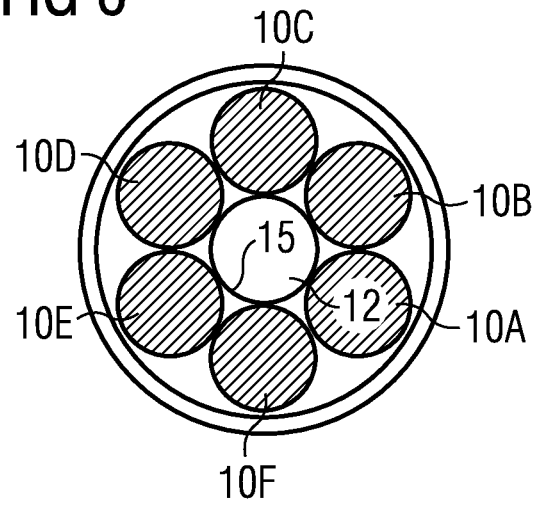

For the sake of completeness, FIG. 6 illustrates a further variant of the liquid cooling, in which a central tube or pipe carrying the cooling medium as a liquid-carrying conduit 12 is surrounded by the part-conductors 10A, 10B, . . . , 10F. The part-conductors 10A, 10B, . . . , 10F together represent the inductor 10 in this case. In this embodiment, the tube diameter or pipe diameter of the liquid-carrying conduit 12 can preferably be between 10 and 100 mm and the mass flow of the cooling medium can be between 5 and 100 l/min. The inductor 10 can consist of e.g. 10-2000 part-conductors, whose total cross-sectional area is typically 10-2000 $mm^2$.

While mere transportation of cooling liquid is described above, this is combined in the following with a means of discharging liquid into the deposit 6 along the length of the liquid-carrying conduit 12.

Figure 7:
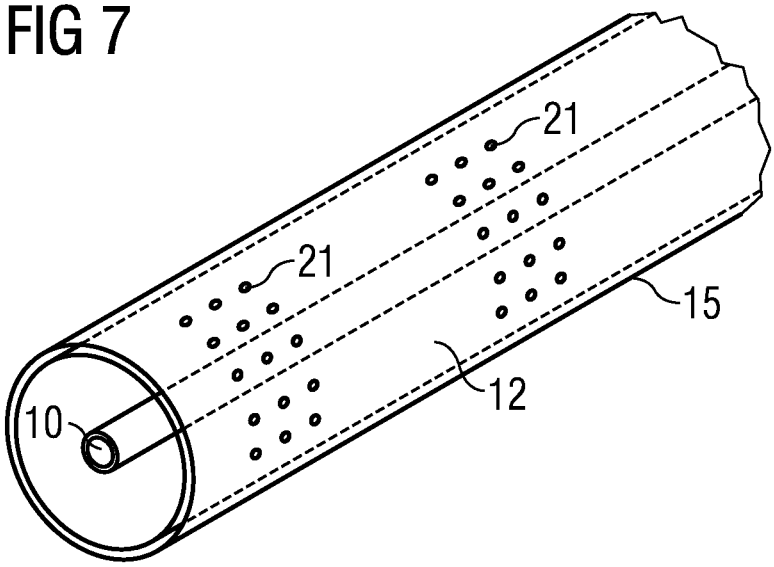
FIG. 7 shows a perforated liquid-carrying conduit.

FIG. 7 schematically shows a section of an inductor 10 with a surrounding cooling element in a perspective illustration, wherein a liquid-carrying conduit 12 is designed to be perforated such that liquid can escape, wherein the liquid can actually escape in liquid form or possibly also as gas, e.g. steam.

In a similar manner to FIG. 2, an inductor 10 that is centrally arranged in a tubular casing 15 is surrounded by a liquid-carrying conduit 12. Unlike the embodiment in FIG. 2, the liquid-carrying conduit 12 or the casing 15 features a perforation 12 consisting of a multiplicity of holes and outlets through which the transported liquid can penetrate from the interior to the exterior. The size, position and frequency of the holes must be adapted to the desired conditions in this case, and should not be interpreted restrictively from the illustration in FIG. 7, in particular such that e.g. 30-300 l/min can escape along the entire length of the liquid-carrying conduit 12.

The holes of the perforation 21 can be arranged symmetrically around the overall circumference of the casing 15 in this case. However, an unequal distribution can also be advantageous. The distribution and/or the embodiment of the holes can also change over the length of the liquid-carrying conduit 12, in particular since the pressure within the liquid-carrying conduit 12 can change as a result of the escaping liquid.

In this case, liquid escaping into the deposit 6 in the environment of the inductor 10 is advantageous to the extent that an electrolyte can be injected into the reservoir in this way, thereby allowing the electrical conductivity in the deposit 6 to increase and producing a higher pressure within the deposit 6. Both effects allow an increase in the extraction quota and/or the extraction speed of the substance containing hydrocarbons that is to be extracted. Further explanations relating to this are given with reference to FIG. 8.

Figure 8:
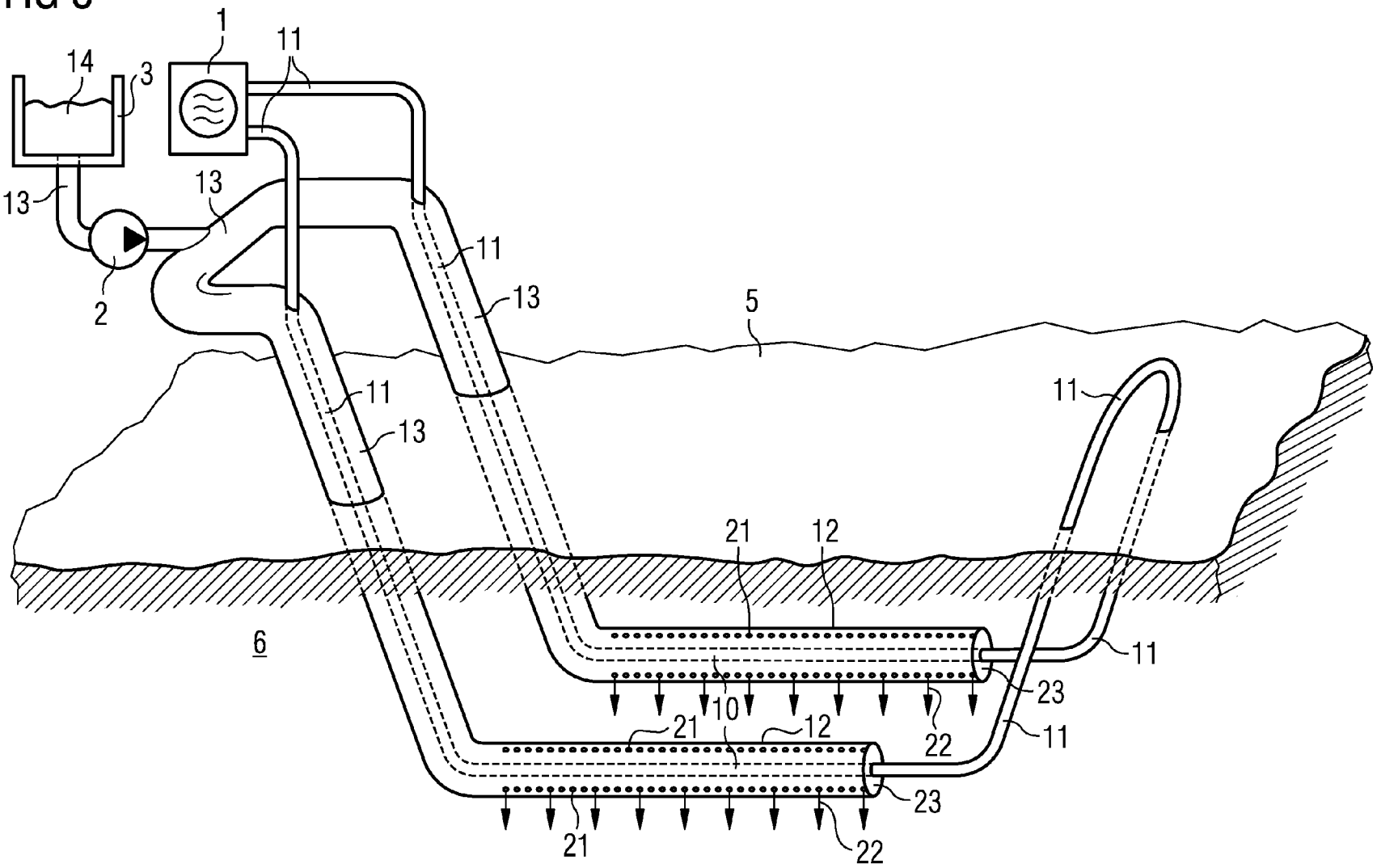
FIG. 8 shows an apparatus for injecting a liquid into the reservoir.

The layout of FIG. 8 corresponds essentially to that of FIG. 1. Provision is made for a conductor loop that is operated by an electricity supply 1. Sections functioning as electrodes are highlighted as inductors 10. These are the sections that run horizontally in parallel in the deposit 6.

Also present is a container 3 for providing a liquid 14 that is intended as a cooling liquid. This liquid 14 is introduced by means of the pump 2 into a liquid system consisting of the liquid entry lines 13 and the liquid-carrying conduit 12. The liquid-carrying conduit 12 is again intended to represent the sections running horizontally and in parallel in the deposit 6. The liquid entry lines 13 comprise the tube/pipe system above the ground 5 and the connection to the horizontal liquid-carrying conduit 12.

Unlike FIG. 1, the supply in the present example is effected from the left-hand side of the drawing, though a supply from the right-hand side as in FIG. 1 is also possible. A more significant difference relative to FIG. 1 is however that in the horizontal underground section the liquid-carrying conduit 12 has a perforation 21 via which liquid 22 escapes as indicated by arrows. Moreover, the liquid-carrying conduit 12 in the present example already terminates underground. A seal 23 of the liquid-carrying conduit 12 is provided for this purpose, wherein said seal can likewise feature a perforation.

Contrary to the present embodiment, it is however also conceivable for the liquid-carrying conduit 12 to be routed back to the surface for a remaining liquid residue. Alternatively, it is possible for the liquid-carrying conduit 12 to be routed back to the surface, but for no liquid to reach the surface 5 due to the pressure ratios. The last section of the liquid-carrying conduit 12 would therefore contain no liquid.

Liquid is introduced into the cooling system during operation by means of a pump 2 or an apparatus functioning in a similar manner. The pressure remains largely unchanged as far as the liquid-carrying conduit 12, since no liquid outlet is provided until the start of the liquid-carrying conduit 12. When the supplied liquid reaches the section featuring the inventive liquid-carrying conduit 12, a portion of the liquid is introduced into the deposit 6 via the perforation 21. A further portion of the liquid flows further along the liquid-carrying conduit 12, wherein liquid is continuously discharged via the perforation 21. An outflow of the liquid is therefore produced as a result of the escaping liquid 22. The loss of liquid is replaced via the pump 2 by top-up liquid.

A number of effects are therefore produced: firstly the liquid flows along the inductor 10 and can carry heat away. Secondly the liquid flows into the deposit 6 in the vicinity of the inductors 10, whereby the pressure in the deposit 6 can be increased or a pressure that is falling off due to the extraction of the substance containing hydrocarbons can be equalized, and the electrical conductivity in the deposit 6 can be increased in the vicinity of the inductors 10 in particular, which in turn increases the efficiency of the inductors 10. The cited effects are mutually influential, since the discharge of the heated liquid into the environment of the inductor 10 causes cool liquid to subsequently flow along the inductor 10 within the liquid-carrying conduit 12, thereby maintaining the cooling or thermally insulating effect.

The seal 23, the dimensions of the liquid-carrying conduit 12, the embodiment of the perforation 21 and the pressure that is applied to the liquid via the pump 2 should preferably be adapted to each other, giving particular consideration to the available rock information and the depth of the deposit, such that to a large extent the cited effects occur and/or liquid 22 escapes evenly into the deposit 6 over the entire length of the horizontally oriented inductor 10.

The pressure is dependent on the depth of the deposit, i.e. on the distance of the horizontally installed inductors 10 from the surface 5. The pressure should be greater than the hydrostatic pressure of the corresponding water column and lies in the range between 10,000 hPa (10 bar) and 50,000 hPa (50 bar), for example.

Pressure relief in the deposit 6 is effected by opening the production pipe(s) (not shown) at such time as the pressure on a capping above the deposit 6 becomes excessive. However, it can be advantageous to keep the production pipes closed for as long as possible in order to achieve a high pressure.

The function of the escaping liquid 22 is therefore both to increase or maintain the pressure in the deposit 6 and to displace (flush out) the substance that is to be extracted, thereby also preventing underpressure in the deposit 6.

In particular, the liquid can be an electrolyte such as water or an aqueous solution, e.g. mixed with other constituents. In particular, the electrolyte, displacer or solvent can comprise organic or inorganic liquids, gases in a different state of aggregation, or combinations thereof, in particular water (preferably production water that has been separated from heavy oil), saltwater, weak acids, weak bases, other solvents such as methane, propane, butane, $C0_2$, or mixtures thereof.

The cross sections shown in the FIGS. 2 to 5 are also applicable in the case of a liquid-carrying conduit 12 from which liquid 22 escapes.

According to the embodiment in FIG. 2, the inductor 10 can be located in a perforated injector pipe/tube in which no provision is made for centering the inductor 10. The diameter of the inductor 10 is preferably 30-100 mm. The annular gap width is preferably 5-50 mm and the mass flow of the cooling medium is preferably 30-300 l/min.

According to FIG. 3, the inductor 10 is located in a perforated injector pipe/tube, wherein support for the inductor 10 is provided by star-shaped spacers. The diameter of the inductor 10 is preferably 30-100 mm. The annular gap width is preferably 5-50 mm and the mass flow of the cooling medium is preferably 30-300 l/min.

According to FIG. 4, one or more perforated injector pipes/tubes are attached to the inductor 10. The direct contact between the inductor 10 and the reservoir is provided. Omission of the contact can even be advantageous, since the heat transfer from the surrounding hot reservoir back onto the inductor 10 is reduced. The diameter of the inductor 10 is preferably 30-100 mm. The diameter of the adjacent pipes is preferably 5-50 mm and the mass flow of the cooling medium is preferably 30-300 l/min.

In the case of the embodiment described in FIG. 8, it is advantageous in particular that more cost-effective and higher power densities can be achieved. It is possible at the same time to prevent overheating of the inductor 10 (which also represents a risk at greater depths) and to achieve additional displacement of the substance that is to be extracted from the deposit. Moreover, deposits having limited electrical conductivity can only be inductively heated as a result of this liquid being fed into the deposit.

In contrast with FIG. 8, the apparatus in a further implementation variant can be embodied such that only partial regions of the inductor 10 are located in an injector pipe/tube. Moreover, the discharge holes of the perforation 21 can be distributed unevenly or provision can be made for sections in which there is no perforation 21.

With regard to the embodiments cited above, it is again noted that no provision is primarily made for supplying steam which is generated above ground, but that provision is made for supplying liquids. Even a supplementary input of steam is preferably omitted.

Figure 9:
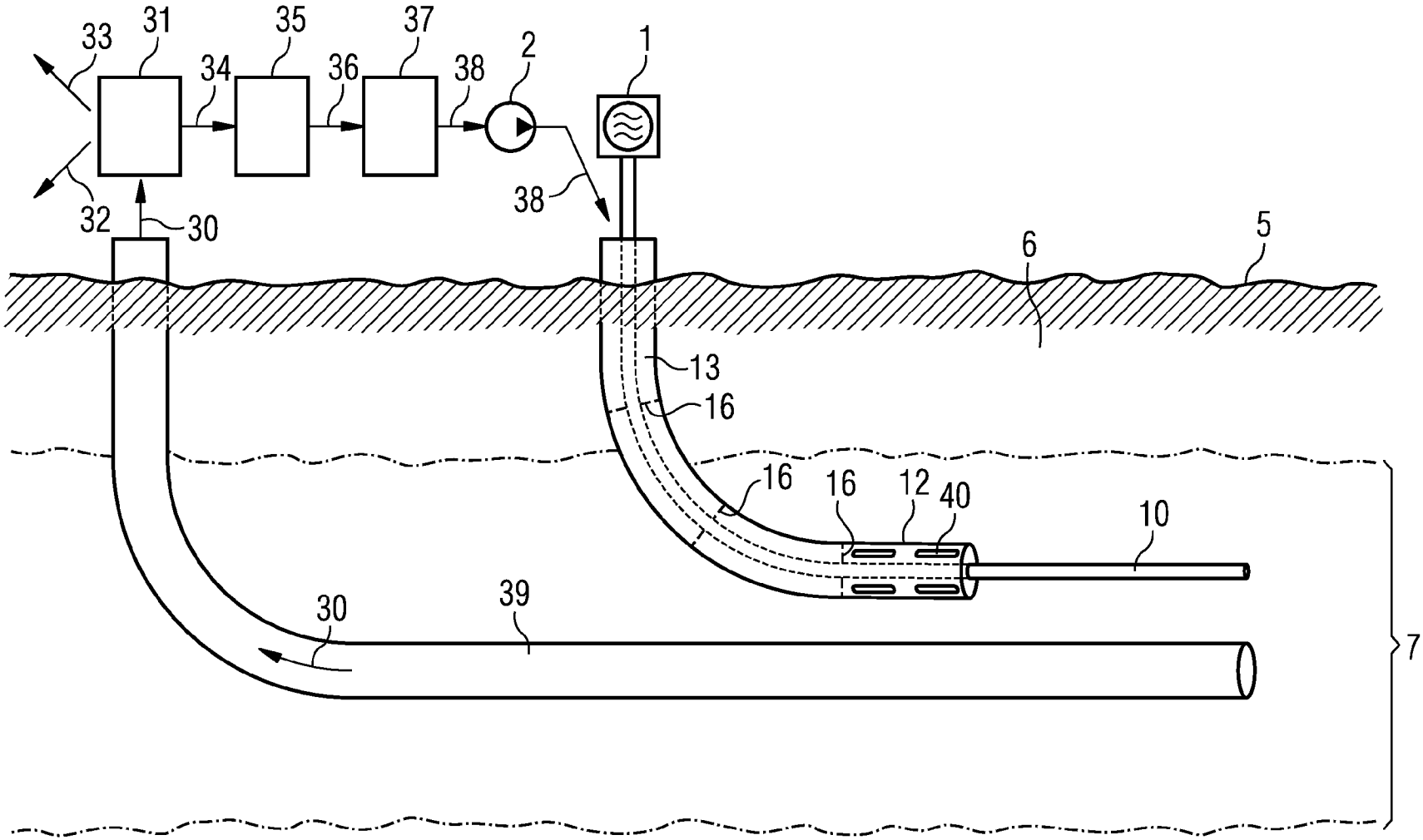
FIG. 9 shows an apparatus for processing and injecting an extracted production flow.

In the case of the foregoing embodiments, further details have not been provided in respect of possible sources of the liquid that is to be introduced into the liquid-carrying conduit. With reference to FIG. 9, it is now explained that this liquid can be wholly or partly extracted from the production flow.

FIG. 9 schematically shows a cutaway of a deposit 6, wherein said deposit 6 is disposed below the surface of the earth 5 and contains a region 7 that features an incidence of oil. A conductor loop is provided as in the previous embodiments, wherein only one inductor 10 of the conductor loop is illustrated in FIG. 9.

In addition, the inductor 10 is encased at least partially by a liquid-carrying conduit 12. The conductor loop is operated by an electricity supply 1 as in the previous embodiments.

Although this is not illustrated in the FIGS. 1 and 8, a production pipe 39 for transporting away the substance to be extracted is provided in the ground in all embodiments of the invention. The production pipe 39 allows a production flow 30 in the form of a liquid-solid-gas mixture (i.e. a phase mixture) to be transported to the surface 5 for processing.

The substance to be extracted is firstly separated from the liquid-solid-gas mixture by means of an oil/gas separator 31. Separated oil 32 resulting therefrom is indicated in the figure as an arrow, as is a separated gas 33 that is alternatively or additionally produced. There remains a residual liquid 34 (produced water) of the separated production flow 30, which residual liquid 34 then undergoes further processing so that it can subsequently be injected into the deposit 6 in liquid form.

As a first processing step, the residual liquid 34 is supplied to a sand removal entity 35, in which sand and other solids are removed. This processing step results in a sand-free residual liquid 36.

As a result of removing the sand, the remaining sand-free residual liquid 36 already has a consistency that is suitable for re-injecting in liquid form. By virtue of the sand-free residual liquid 35, a pipe that is used for re-injection can obviously be operated over the long-term without becoming blocked or sanded up.

A further processing step takes place according to FIG. 9. The sand-free residual liquid 36 is supplied to a desalination entity 37, which reduces the salt content of the sand-free residual liquid 36. This can be achieved by adding specific chemicals. A salt content corresponding to a natural salt content within the deposit 6 is ideally achieved in the resulting processed liquid 38 by virtue of the desalination entity 37.

Further processing steps can be omitted, since provision is inventively made for introducing a liquid (in liquid form and not as a gas) into the deposit 6 and along the inductor 10 by means of the liquid-carrying conduit 12. The processing can therefore be restricted to sand removal and desalination.

The liquid 38 thus processed can then be supplied into the cooling circuit as per FIG. 1 or supplied to the liquid injection facility as per FIG. 8. A further alternative variant is explained below with reference to FIG. 9.

According to FIG. 9, the processed liquid 38 is supplied to a pump 2 and forced under pressure into the liquid entry line 13, which subsequently merges into the liquid-carrying conduit 12. The inductor 10 is again guided within the liquid entry line 13 and the liquid-carrying conduit 12. The previously described embodiments of the inductor within a liquid-carrying conduit remain valid, in particular the embodiments according to the FIGS. 2 to 4. For example, FIG. 9 illustrates an embodiment in which the inductor 10 is held by means of ridges 16 that are sectionally present within the liquid-carrying conduit or entry line.

The processed liquid 38 is therefore introduced deep into the deposit 6 inside a tube or pipe along the inductor 10 within the liquid entry line 13 and the liquid-carrying conduit 12. In order that the liquid 38 can then be injected into the soil of the deposit 6 over a greater length, the liquid-carrying conduit 12 is slotted such that the liquid 38 can penetrate via slots 40 from the liquid-carrying conduit 12 into the subsoil.

The penetrating liquid can vaporize there over time due to the heating effect of the inductor 10.

According to FIG. 9, the length of the liquid-carrying conduit 12 is limited and terminates, while the inductor 10 continues onwards horizontally. The length of the slotted liquid-carrying conduit 12, the frequency and the size of the slots 40, and the quantity of the liquid 38 that is forced in should be coordinated with each other in this case.

In an alternative embodiment, the liquid-carrying conduit 12 can be provided essentially along the entire active length of the inductor 10 as in FIG. 8, in order to ensure more extensive distribution of the injected liquid.

The approach explained with reference to FIG. 9 is advantageous in that the required water processing is less resource-intensive than it is for the steam-based method, since the injection water does not have to be vaporized above ground.

Water that has been heated via continuous heat exchangers (not shown in FIG. 9) can also be used for the injection, in order to avoid unwanted cooling of the deposit and hence a drop in pressure or an increase in viscosity in the deposit.

It is also advantageous that the entity for temperature maintenance and therefore also for pressure management in the reservoir is easy to adjust.

Further advantages of the above described combination of the medium-frequency inductive method for heating the reservoir with the simplified method for water processing and water re-injection are considered to include, for example, the fact that process engineering overheads required to establish the overall water processing plant are reduced, in particular for the feed water processing, and that waste water is avoided or reduced.

In comparison with the generation of steam for injection into the reservoir, a clear energy saving is achieved as a result of avoiding the heat losses that are produced during the steam generation.

The invention claimed is:

1. An apparatus for extracting a substance containing hydrocarbons from a reservoir, wherein the reservoir can be subjected to thermal energy in order to reduce the viscosity of the substance, the apparatus comprising:

at least one conductor loop for inductively applying current as an electric/electromagnetic heater, wherein a conductor of the conductor loop is surrounded in at least one section by a liquid-carrying conduit, and that the liquid-carrying conduit is perforated such that when a liquid is supplied the liquid penetrates into the reservoir from the liquid-carrying conduit via a perforation, and wherein the liquid-carrying conduit is embodied as a plurality of tubes or pipes such that each tube or pipe of the plurality of tubes or pipes is perforated, and wherein the conductor is surrounded by the plurality of tubes or pipes.

2. The apparatus as claimed in claim 1, wherein the plurality of tubes or pipes and the conductor are arranged within a shared tubular outer sleeve.

3. The apparatus as claimed in claim 1, further comprising a pressurization device for increasing the pressure of a liquid and for circulating the liquid, such that movement of the liquid is achieved and a liquid is introduced into the liquid-carrying conduit at higher pressure by virtue of the pressurization device.

4. The apparatus as claimed in claim 1, wherein the perforation is embodied and/or means are provided such that any ingress of solids and/or sand from the reservoir into the liquid-carrying conduit is substantially prevented.

5. The apparatus as claimed in claim 1, wherein the perforation comprises holes which are so embodied in terms of shape and/or size and/or distribution that when a liquid is supplied at a predefined pressure a) the conductor is sufficiently cooled over the entire length of that section of the conductor loop which is surrounded by the liquid-carrying conduit, and/or b) the liquid is discharged in a distributed manner along a length of the liquid-carrying conduit through the perforation into an environment of the conductor loop in the reservoir, such that the electrical conductivity of the reservoir is changed, and/or the pressure in the reservoir is increased.

6. An apparatus for extracting a substance containing hydrocarbons from a reservoir, wherein the reservoir can be subjected to thermal energy in order to reduce the viscosity of the substance, the apparatus comprising:

at least one conductor loop for inductively applying current as an electric/electromagnetic heater, wherein a conductor of the conductor loop is surrounded in at least one section by a liquid-carrying conduit, and that the liquid-carrying conduit is perforated such that when a liquid is supplied the liquid penetrates into the reservoir from the liquid-carrying conduit via a perforation, wherein the liquid-carrying conduit is designed as a tube or pipe, the tube or pipe comprising an exterior outer casing with a hollow interior, the conductor being arranged within the tube or the pipe, wherein the tube or the pipe is arranged approximately coaxially relative to the conductor, and wherein at least one ridge is provided within the tube or the pipe for the purpose of holding the conductor, the ridge extending from the conductor to the inner wall of the outer casing, wherein the at least one ridge is attached within the tube or the pipe at the conductor using a stabilizer.

* * * * *